US006294761B1

(12) United States Patent
Diederich et al.

(10) Patent No.: US 6,294,761 B1
(45) Date of Patent: Sep. 25, 2001

(54) HEAT-RESISTING PACKAGE FOR HOT-MELT ADHESIVE

(76) Inventors: Raymond David Diederich, 49 New Tudor Rd., Pittsford, NY (US) 14534; Walter E. Littman, 1203 River Rd., Apt. 15H, Edgewater, NJ (US) 07020

( * ) Notice: Subject to any disclaimer, the term of this patent is extended or adjusted under 35 U.S.C. 154(b) by 0 days.

(21) Appl. No.: 09/452,414

(22) Filed: Dec. 1, 1999

(51) Int. Cl.[7] ..... B65D 81/18; B65D 33/38; B65D 90/04

(52) U.S. Cl. ..... 219/386; 219/201; 220/1.6; 222/105; 222/146.5; 383/906

(58) Field of Search ..... 219/200, 201, 219/214, 385, 386, 420, 421, 424, 429, 432, 433; 222/92, 93, 105, 146.5; 206/813; 220/1.6; 383/59, 60, 906

(56) References Cited

U.S. PATENT DOCUMENTS 4,574,986 * 3/1986 Baris et al. ..... 222/94
4,629,094 * 12/1986 Vogel et al. ..... 222/146.5
5,145,083 * 9/1992 Takahashi ..... 222/105
5,181,625 * 1/1993 Podd et al. ..... 220/1.5
5,206,309 4/1993 Altman .
5,335,820 * 8/1994 Christianson ..... 222/105
5,356,029 * 10/1994 Hogan ..... 222/105
5,655,679 * 8/1997 Schutz ..... 220/403
5,680,955 * 10/1997 Schutz ..... 220/1.5
5,681,115 10/1997 Diederich et al. .
5,706,872 * 1/1998 Schlesinger ..... 219/385
5,750,216 * 5/1998 Horino et al. ..... 222/92
5,824,995 * 10/1998 Wise ..... 219/386
5,851,072 * 12/1998 LaFleur ..... 383/906
5,971,185 * 10/1999 Schutz ..... 220/1.6
5,979,685 * 11/1999 tz ..... 220/1.6
6,056,157 * 5/2000 Gehl et al. ..... 222/105
6,120,181 * 9/2000 Wilcox ..... 383/41

* cited by examiner

*Primary Examiner*—Joseph Pelham
(74) *Attorney, Agent, or Firm*—Stephen B. Salai, Esq.; Brian B. Shaw, Esq.; Harter, Secrest & Emery LLP

(57) ABSTRACT

A method for heat-sealing a sheet of heat-resisting polymer to a heat-resisting polymeric fitment, which enables the fabrication of a containment and delivery system for a bulk quantity of meltable adhesive, wherein a rigid container is lined by a heat-resisting flexible envelope, with a heater interposed between them. Ports are sealed to the envelope to permit the filling and draining of molten adhesive.

40 Claims, 4 Drawing Sheets

HEAT-RESISTING PACKAGE FOR HOT-MELT ADHESIVE

FIELD OF THE INVENTION

The present invention relates to the packaging of hot substances including hot-melt adhesives, and in particular to packages including a flexible liner capable of withstanding such substances, without compromising package integrity.

BACKGROUND OF THE INVENTION

This invention relates to hot melt adhesives which are used in industry in a wide variety of applications, and in particular to their packaging for shipment to the user and their utilization in the user's manufacturing operations.

In prior art hot melt adhesive packages, considerable secondary processing of the adhesive is required. Molten adhesive at the point of production is commonly poured onto a moving chilled belt, which rapidly solidifies in the form of a ribbon. The solid ribbon is then cut into sticks and typically packed into cartons of about 50 lb (25 kg) and shipped to the customer. Other shapes such as pillows, chicklets or pellets may also be formed for shipment to the customer. At the customer's facility, the solid pieces are transferred with a worm feed or directly by hand to a vat in which the adhesive is remelted, and therefrom dispensed for use. Since in some cases the contents of a single carton may be used up quickly, constant attention is needed to ensure that the vat is replenished. In some cases the vat may be open topped, thus putting the operator at risk of being burned by hot adhesive. The use of relatively small packages results in the consumption of large amounts of packaging material which has to be disposed of by the customer. Also, in facilities which use more than one type of adhesive, the presence of large numbers of small packages increases the possibility of error.

SUMMARY OF THE INVENTION

It is an object of this invention to allow the packaging and shipping of adhesive which originates in a molten flowable state so as to minimize secondary processing, thus reducing shipping, manufacturing and handling costs. The invention comprises a package having a flexible envelope of heat resisting material, a rigid holder for the envelope, and ports sealed to the envelope to permit the filling and draining of hot melt. It further comprises an electrical heater with a temperature measuring device and a control system. Finally, the invention comprises a method for forming a durably impervious seal between the flexible envelope material and the ports. The package is filled with hot melt adhesive and allowed to cool. It is shipped to the user and the contents are reheated by activation of the heater. The use of the shipping container as the reheating vessel allows the aforementioned vat to be eliminated. Furthermore, the package, including the envelope and/or the heat, can be re-used, possibly resulting in a significant economic benefit. Optionally, instead of being allowed to cool, the adhesive can be kept in its molten state by applying the necessary heat at all stages of its handling including transportation. This allows the end user to avoid losing time in reheating the adhesive. The invention allows the shipping of adhesive in quantities of up to about 330 gallons (1245 l), with a mass of about 3300 lb (1500 kg). When such quantities are dispensed in a controlled manner, considerably less labor is required than heretofore. Furthermore, the handling of relatively few large packages reduces the risk of dispensing the wrong adhesive in error.

Flexible containers for liquids obviously must be formed from a flexible material. For liquids at and near room temperature, a variety of materials are available to choose from, such as polyethylene, polypropylene, paper, foil and metallized laminates. Materials for use under relatively benign thermal conditions are easily processed with regard to their ability to be shaped and to be sealed to themselves or other fitments by the use of heat-sealing or adhesive techniques. With increasing temperatures, the problem becomes more challenging. While various polymeric sheet materials which are capable of retaining their integrity at temperatures of up to about 800° F. (425° C.) are known in general, and layers of such sheets may be heat-sealed together, it has not been disclosed to form reliably impervious heat-seals between such materials and fitments which must be attached thereto.

Therefore, it is a purpose of this invention to provide an impervious heat-seal between a sheet of heat-resisting polymer and a rigid fitment block which selectively allows or impedes the passage of a molten substance through the sheet.

It is further a purpose of the invention to provide a system comprising a flexible envelope for molten substances, the envelope having impervious heat seals with inlet and outlet fixtures and retaining its structural integrity at temperatures of up to 150° C., and preferably up to at least 200° C. The formation of such impervious seal between the envelope and the fixtures is critical for practical applications of this invention.

According to a first embodiment, this invention provides a receptacle for containing a molten material, comprising: a flexible envelope impervious to the molten material and including an inlet and an outlet; an inlet port imperviously sealed to the envelope at the inlet and extending outward from the inlet; and an outlet port imperviously sealed to the envelope at the outlet and extending outward from the outlet; wherein the receptacle retains its structural integrity up to a temperature of at least 150° C., and preferably up to at least 200° C.

According to other embodiments, the invention relates to a method for containing, transporting and dispensing a material. The method comprises: providing a receptacle that comprises a flexible envelope impervious to the material when molten and including an inlet and an outlet, a rigid holder into which the flexible inlet is disposed, and a heating element disposed between the rigid holder and the envelope, and in thermal contact with an exterior of the envelope; introducing the molten material into the envelope through an inlet port extending from the envelope inlet and an exterior of the container; closing the inlet port, and transporting the container to a desired location; activating the heating element to heat the material to a desired temperate in its molten state; and dispensing the material in its molten state from an outlet port extending from the envelope outlet and the exterior of the container; wherein the receptacle retains its structural integrity up to a temperature of at least 150° C.

This invention also relates to a method of forming a seal between a flexible sheet and a contact surface of a rigid block, comprising: providing a flexible sheet of a material having an aperture therethrough; providing a rigid block of material including a lower flange; inserting the rigid block through the aperture such that an upper surface of the lower flange contacts an inner surface of the flexible sheet surrounding the aperture; placing the rigid block flange surface and the flexible sheet inner surface in contact with a preheated support surface, and applying pressure for a predetermined time to form a seal between the flange and flexible sheet that is impervious to molten substances at a temperature of at least 150° C.

In particular, the present invention discloses regimes of temperature, pressure and time in which heat seals can be made between a sheet of heat-resisting polymer and a rigid fitment. The capability of making such heat seals enables the fabrication of flexible envelopes for receiving, containing and dispensing hot fluids at temperatures up to about 200° C., which in turn enables the fabrication of packaging systems which enable bulk quantities of such fluids to be admitted, contained, transported and dispensed.

DETAILED DESCRIPTION OF THE PREFERRED EMBODIMENT

Figure 1:
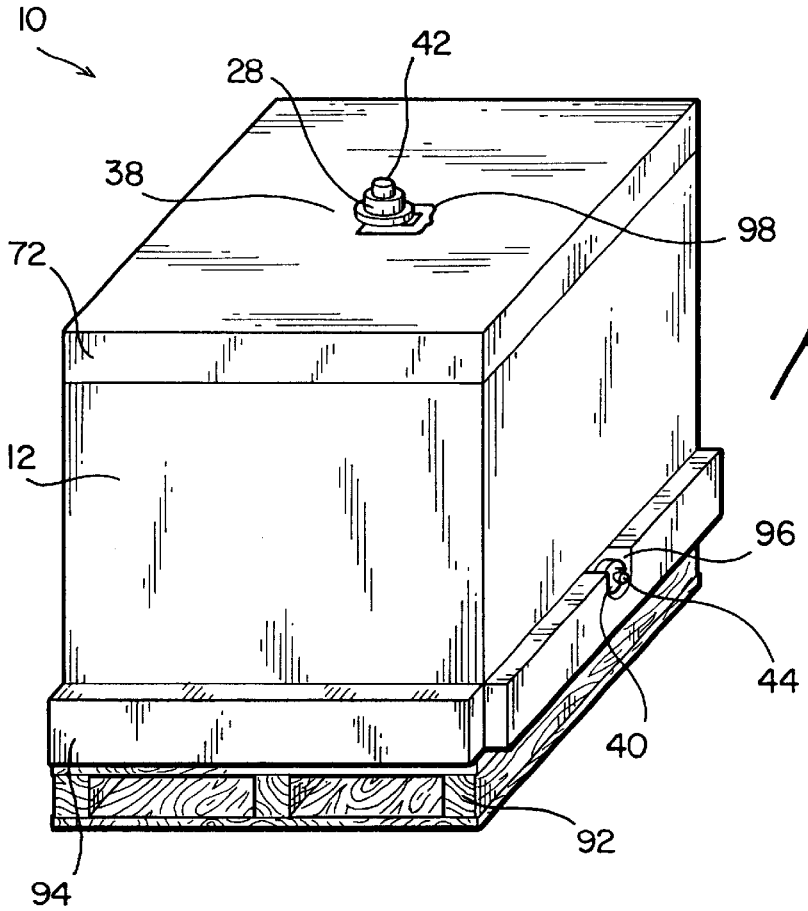
FIG. 1 is a perspective view of a package for meltable adhesive.
Figure 2:
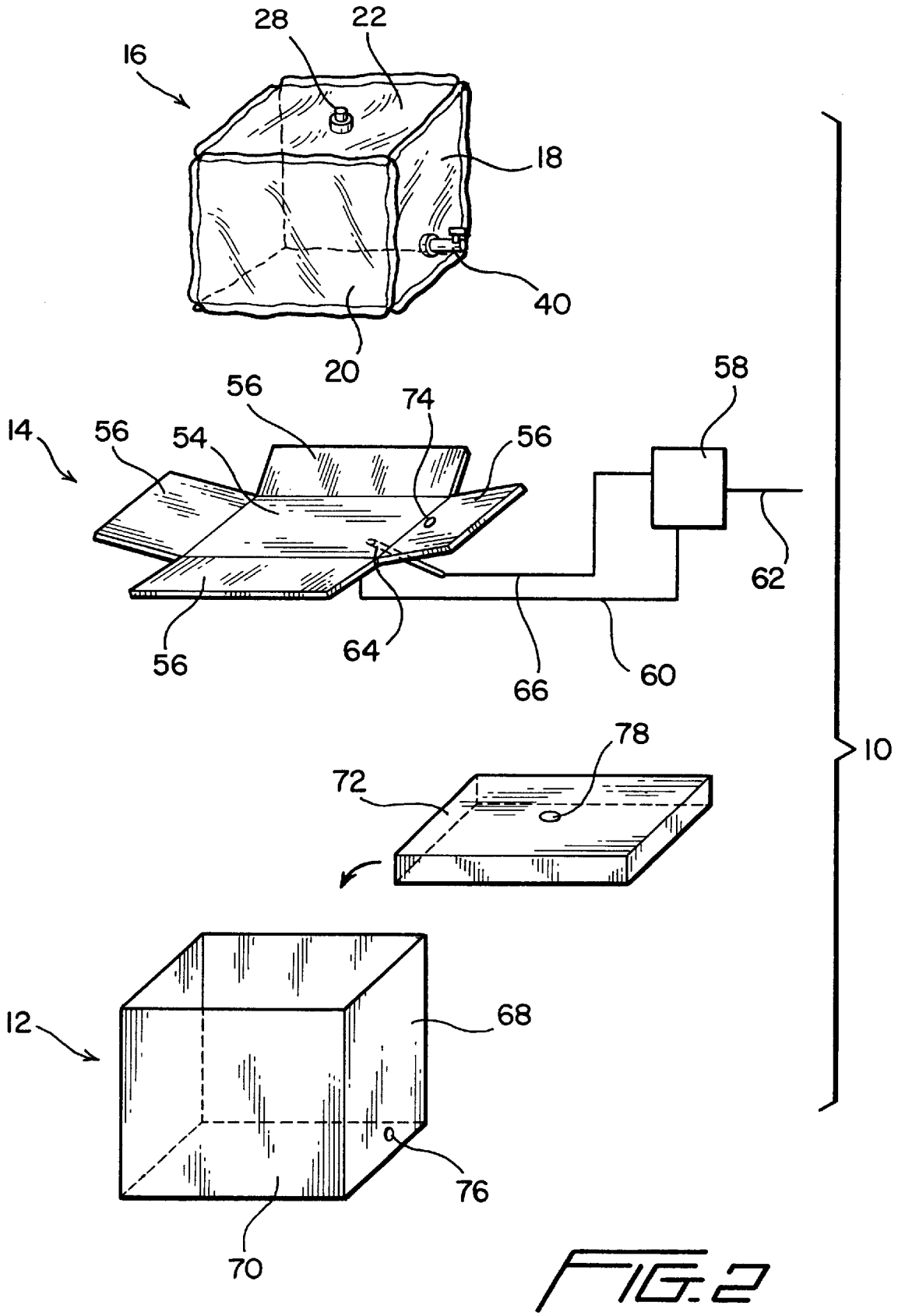
FIG. 2 is a an exploded view of major components of the package.
Figure 3:
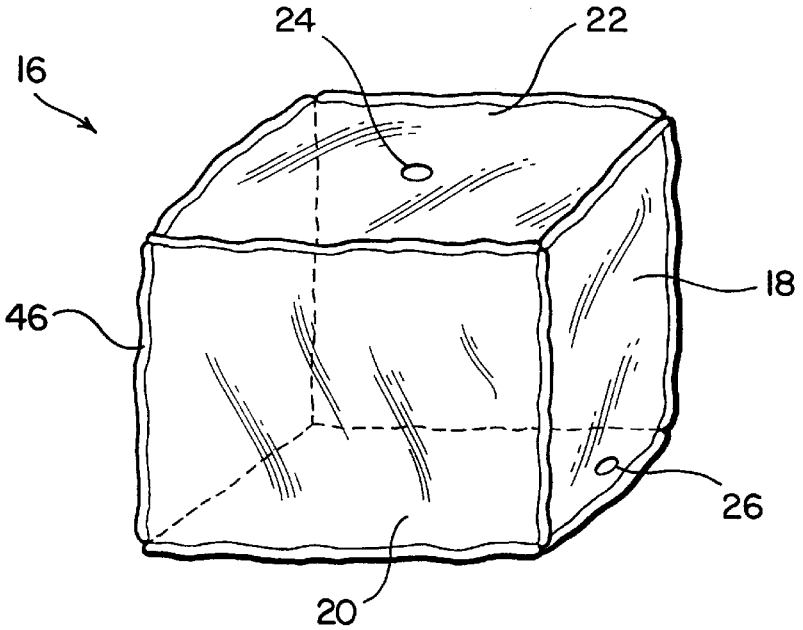
FIG. 3 is a perspective view of a flexible envelope in an expanded form.

FIG. 1 shows a simplified perspective view of a package 10 for containing and transporting a bulk quantity of hot-melt adhesive, and FIG. 2 shows in schematic form a partial, exploded view of the same package. Package 10 comprises a rigid holder 12, a heater 14 and a flexible impervious envelope 16. In the illustrated embodiment, the envelope is also shown in FIG. 3. Envelope 16 has a polyhedral shape close to that of a cube, having six facets comprising four rectangular sides 18, a rectangular base 20 and a rectangular top 22, each of which is orthogonal to its nearest neighbors. The top 22 has a centrally located inlet hole 24, and one side 18 of the envelope 16 has an outlet hole 26 near to its lowest edge and centered along that edge.

Figure 4:
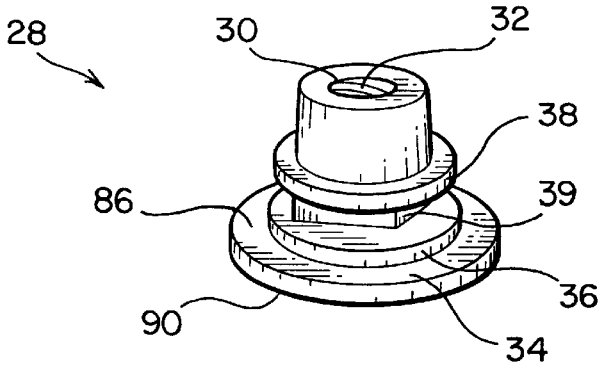
FIG. 4 is a perspective view of a port.

FIG. 4 shows an inlet port 28 for installation at inlet hole 24. Port 28 has a generally cylindrical shape, a cylindrical opening 30 through its entire length, and an interior thread 32. A flange 34 extends outwardly from one end of port 28, in a plane which is perpendicular to the axis of the port 28. Immediately adjoining flange 34 is a step or flange 36 of circular cross-section having a diameter smaller than that of flange 34. Spaced apart from step 36 is a second step or flange 38 of similar dimensions. Between steps 36 and 38, inlet port 28 has a portion 39 which has a square cross-section of smaller size than steps 36 and 38. Port fixture 28 illustrated in FIG. 4 may be integrally molded as a one-piece constriction.

Envelope 16 contains the hot melt adhesive, and is fabricated from a sheet material which can withstand molten hot adhesive for considerable periods of time. Also, since the quantity of adhesive may be sufficient to supply several production runs, the material must also survive several heating and cooling cycles. The sheet material must be capable of being sealed to itself and to the port material.

For these reasons, the preferred materials for envelope 16 are nylon, and in particular a copolymer of (also known as nylon 6) and poly(epsiloncaprolactam-hexamethylene adipamide) (also known as nylon 6/66), such as the copolymers disclosed in U.S. Pat. No. 5,206,309 and those sold under the trade name Nylon 6-6. Another preferred material is a copolymer of ethylene and tetrafluoroethylene (ETFE), such as copolymers sold under the trade name Tefzel™, with the aforementioned nylon material being the most preferred. The inlet and outlet ports 28, 40 must be also heat resistant to the molten hot melt adhesive that flows therethrough, and are preferably fabricated from a nylon material such as the aforementioned nylon copolymers.

Figure 5:
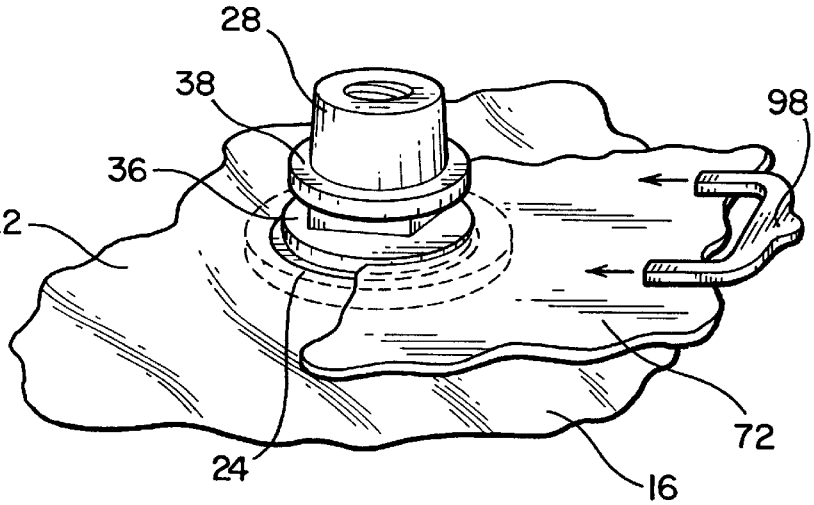
FIG. 5 is a partial view of the package near the port.

In fabricating envelope 16, an inlet hole 24 is cut in the material for the top 22, and outlet hole 26 is similarly cut in one of the sides 18. The diameters of holes 24 and 26 is smaller than the diameter of flange 34. FIG. 5 shows a section of package 10, with inlet port 28 arranged within inlet hole 24 of envelope 16. With flange 34 on the interior side of envelope 16, port 28 is passed through hole 24 until flange 34 contacts envelope 16, steps 36 and 38 being sized to pass through hole 24. Then, flange 34 is heat-sealed to envelope 16, according to a procedure which will be described in more detail below. An outlet port 40 is essentially identical in structure and material to inlet port 28 and is similarly installed at outlet hole 26. Inlet port 28 accepts a closure 42, and outlet port 40 accepts a shutoff 44, at interior thread 32.

To assemble the final cube-like structure, the sides 18, base 20 and top 22 of the envelope are heat-sealed together along their appropriate adjoining edges, by methods generally known in the art, to form impervious seams 46. Optionally, the sides 18, base 20 and top 22 may be fabricated from a single piece of material appropriately folded, to reduce the number of edges which need to be heat sealed. In the assembled envelope, ports 28 and 40 are outwardly directed with their flanges 36 on the inside.

Figure 6:
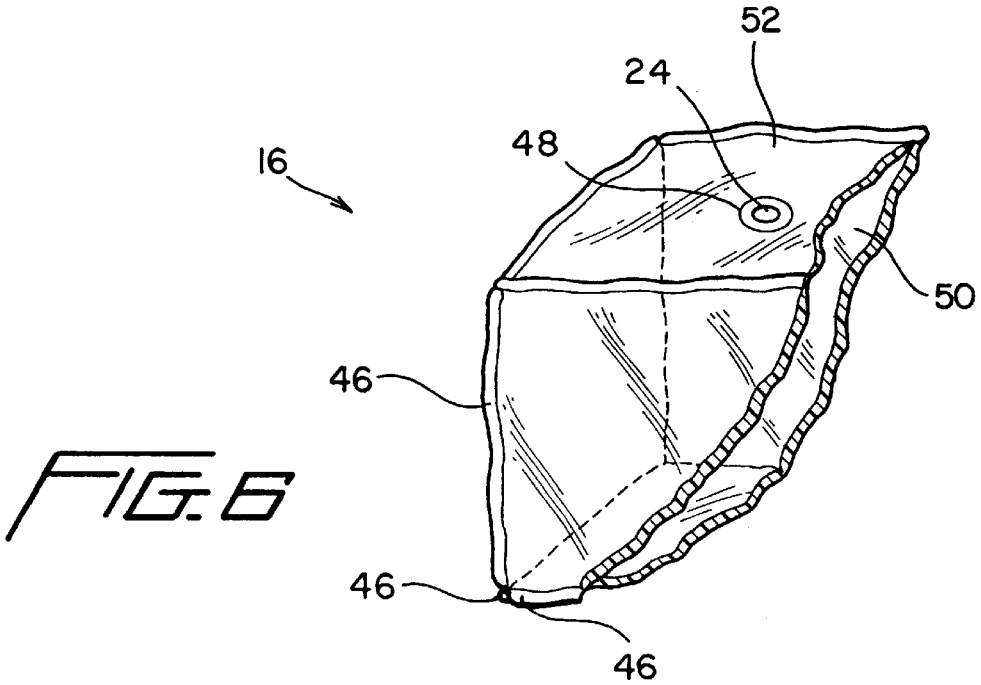
FIG. 6 is a cutaway view of the envelope.

FIG. 6 is a cutaway view of envelope 16 in a preferred embodiment of the invention, wherein envelope 16 comprises an inner pouch 50 and a similarly structured outer pouch 52, each pouch being impervious to molten adhesive, as a safety feature to guard against spillage in the event one of the pouches is punctured. In the heat-sealing process, the pouches 50 and 52 are sealed together along all proximate edges. In effect, the result is an envelope each of whose sides 18, base 20 and top 22 has two thicknesses of material bonded together around its perimeter along seams 46. The two thicknesses are also heat-sealed together at a seam 48 around inlet hole 24, and similarly around outlet hole 26.

Heater 14, shown in FIG. 2, has a rectangular central pad 54 and four rectangular flaps 56, each of which is foldably attached to a different edge of the central pad 54. The heating elements in central pad 54 and the flaps 56 are electrically interconnected.

The heater 14 receives its power from a controller 58, whereto it is connected by a removable conductor 60. A second conductor 62 provides power from an electrical supply to controller 58. Optionally the heater 14 has attached to it a thermocouple 64 for sensing its temperature and providing feedback to controller 58, in which case thermocouple 64 connects through a removable lead 66 with controller 58.

Holder 12 has four walls 68, a base 70 and a cover 72, and accommodates the heater 14. The central pad 54 of heater 14 is sized to conform with the base 70, and the flaps 56 of heater 14 are folded upwardly against walls 68 of holder 12. To avoid excessive stress on envelope 16 when it is filled, its expanded form is slightly oversized relative to holder 12, so that all points below the fill line are supported by holder 12.

The base 20 of envelope 16 rests on the central pad 54 of heater 14 such that each flap 56 is upwardly folded and interposed between a side 18 of the envelope 16 and a wall 68 of the holder 12. In one flap 56 of the heater 14 and one wall 68 of the holder 12 are, respectively, holes 74 and 76 which are sized to accept the outlet port 40 from envelope 16. Cover 72 has a hole 78 to accept inlet port 28, which is maintained in a fixed position as will be described. Other types of heating elements may be employed, so long as the heating element is in thermal contact with the adhesive contained in the flexible envelope.

While holder 12 can be fabricated from any conventional rigid material, such as plywood or a heat resistant corrugated paperboard, the latter is preferred since it can easily be provided in a collapsed form and opened only as needed for use. A suitable corrugated material is available from MacMillan & Bloedel.

Referring now to the process for sealing the envelope material to itself and to the ports, all seals must necessarily be impervious to molten substances to which they are exposed. In order to form seals that withstand aggressive thermal and chemical regimes, the preferred method is heat-sealing, whereby two surfaces are brought under pressure with the simultaneous application of heat, which causes them to flow together and merge. While flexible sheets of Nylon 6-6, Tefzel and like materials are known in the art to have been heat-sealed to each other, it has not been disclosed to form an impervious heat resistant seal between a sheet of Nylon 6-6 or Tefzel and a relatively massive fitment which acts as a heat sink. Normally, the application of sufficient heat to cause a polymeric fitment material to flow has the undesirable consequence of degrading the sheet to an unacceptable degree. Unexpectedly, a regime of temperature, pressure and time has now been discovered which permits the formation of a practical heat seal between a sheet and a massive fitment of heat-resisting polymer.

Figure 7:
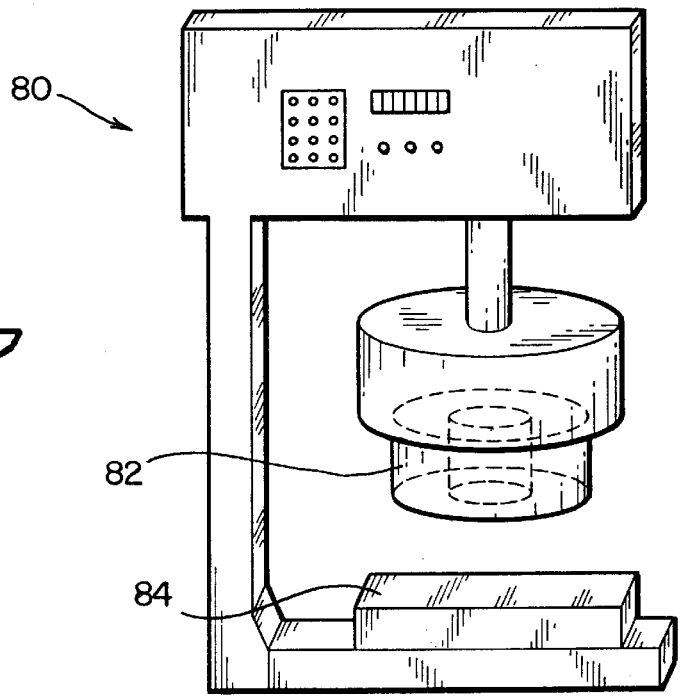
FIG. 7 is a schematic representation of a sealing fixture.
Figure 8:
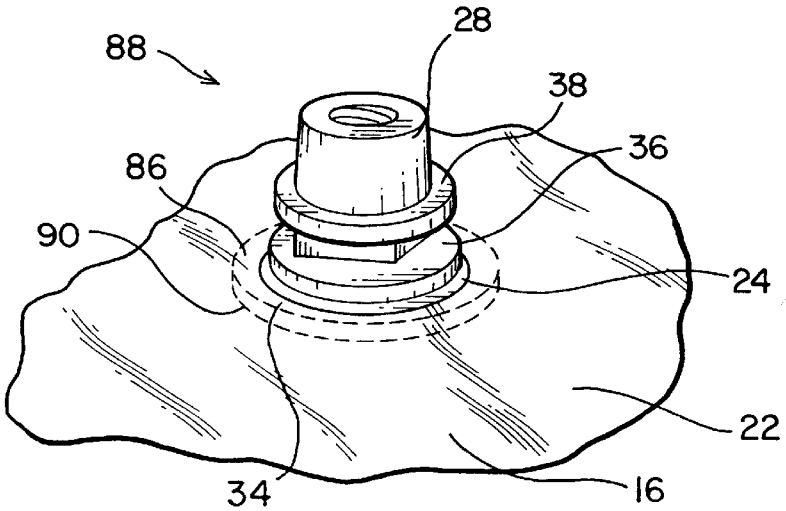
FIG. 8 is a perspective view of work piece.

As shown schematically in FIG. 7, a sealing fixture 80 comprises a press 82 and an anvil 84, which are conformed to accept a fitment with a flexible sheet. Fixture 80 has an open position when the press 82 and the anvil 84 are spaced apart, and a pressing position when they are proximate. Prior to the facets of envelope 16 being sealed together, inlet port 28 is inserted through inlet hole 24 until a contact surface 86 of the flange 34 on port 28 touches the material of the envelope top 22, to form a work piece 88, as shown in FIG. 8. Press 82 and anvil 84 are preheated to a selected temperature, and the workpiece 88 placed between them in the open scaling fixture 80, with an opposed surface 90 of flange 34 placed against the anvil 84. The fixture 80 is next disposed into its pressing position, at a prescribed pressure which is sustained for a specified duration, until contact surface 86 has fused to the material. The fixture 80 is then opened, and the work piece is allowed to cool to solidify and then is withdrawn. In the same manner, outlet port 40 is sealed to the envelope side 18 which has outlet hole 26.

In the case that the flexible sheet and the fitment are both made from a copolymer of polyepsiloncaprolactam and poly(epsiloncaprolactam-hexamethylcne adipamide), the pressing temperature is preferably at least 300° C., more preferably between 315 and 325° C., the applied pressure is preferably at least 500 kPa, more preferably between 620 and 690 kPa, and the pressure is preferably maintained for at least 60 seconds, more preferably between 80 and 100 seconds. In the case that the flexible sheet is made from an ETFE copolymer and the flexible sheet is made from a copolymer of polyepsiloncaprolactam and poly (epsiloncaprolactam-hexamethylene adipamide), the pressing temperature is preferably at least 350° C., more preferably between 375 and 385° C., the applied pressure is preferably at least 500 kPa, more preferably between 690 and 760 kPa, and the pressure is maintained preferably for at least 200 second, more preferably between 220 and 260 seconds.

Package 10 is assembled and used in the following manner. Holder 12, which can be stored in a collapsed form, is opened up and placed on a pallet 92, which provides clearance from floor level and allows the use of a forklift vehicle to transfer package 10 as necessary to a transportation vehicle. A guard 94, which is provided in a collapsed form, is unfolded and placed around the walls 68 of holder 12 near its base 70. Heater 14 is disposed within holder 12 so that its central pad 54 contacts base 70 of the holder, and flaps 56 are opened up against walls 68, with hole 74 of the heater aligned with hole 76 of holder 12. Guard 94 has an opening 96 which is also aligned with holes 74 and 76. Envelope 16 is placed within holder 12 such that outlet port 40 passes through holes 74 and 76 and opening 96. While cover 72 is closed at the top of holder 12, inlet port 28 is positioned to project upward through hole 78 of cover 72, with step 36 generally flush with the cover, and step 38 to the outside of the cover. To secure inlet port 28 in this position, a u-shaped clip 98 is placed astride the square portion 39 of port 28 and frictionally engaged between steps 36 and 38, as is shown in FIG. 5. Outlet port 40 may be similarly secured to a wall 68. Shutoff 44 is engaged with the interior thread 32 of outlet port 40. Guard 94 has sufficient thickness so that shutoff 44 is recessed within opening 96, and is therefore protected from accidental impacts.

With closure 42 removed and shutoff 44 closed, envelope 16 is filled through inlet port 28 with molten adhesive from a supply source. When sufficient melt has been added, closure 42 is put in inlet port 28, and the melt allowed to cool. Package 10 is transferred to a shipping area with a fork lift or other suitable device, onto a transport vehicle and conveyed to a customer's facility, whereat it is moved to a point of use.

At some time prior to hot adhesive being required, thermocouple lead 66 and conductor 60 are connected with the package 10, and the heater 14 is activated, with controller 58 at a desired temperature setting. When the appropriate temperature is reached, shutoff 44 is opened and adhesive is dispensed as required. The adhesive may be dispensed until it is exhausted from the envelope, or in increments between which it may be allowed to cool and then be reheated. A further advantage of preferred embodiments of this invention is that many hot melt adhesives are homogenous materials, in which case mixing of the material in the container is not required while the material is being remelted for dispensing.

Optionally, instead of being allowed to cool once it has been received into the package, the adhesive may be kept in the molten state while being shipped to the customer, so as to save the time involved in remelting the solid. In such a case, an electrical supply and controller 58 can be provided on the transportation vehicle.

After the envelope 16 is drained, the power is turned off, shutoff 44 is closed and controller 58 disconnected from package 10, which is ready to be returned for refilling. Optionally, the same envelope 16 may be re-used, or it may be substituted by another one. A further option is to discard the entire package and use a fresh one. The option selected would be determined by economic and environmental considerations.

We have described an invention the primary purpose of which is to provide a convenient means to contain, ship and dispense substances which are solid at room temperature, but which must be molten at the point of dispensation and use. While the invention can clearly be applied to relatively low-melting solids such as paraffin wax, the ability to form an envelope of heat-resisting materials, and in particular to heat seal fitments to such materials, is what enables the invention to be applied to substances with melt temperatures as high as about 400° F. (200° C.), such as for example required for dispensing hot-melt adhesives. Flexible sheet materials which can survive such temperatures include heat-resisting organic polymers such as a polyaromatic amide, as is sold for example under the trade name Kevlar™; a polyimide, as is sold for example under the trade name Kapton™; an ethylene-tetrafluoroethylene copolymer known as ETFE, as is sold under the trade name Tefzel™; and a nylon such as a copolymer of polyepsiloncaprolactam and poly(epsiloncaprolactam-hexamethylene adipamide) as is sold under the trade name Nylon 6-6. We have shown that, preferably, the aforementioned ETFE and, most preferably, the aforementioned nylon can be used to form seals with a fitment fabricated from a nylon such as Nylon 6-6.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A receptacle for containing a molten material, comprising:

a flexible envelope constructed of a flexible sheet of ethylene and tetrafluoroethylene and impervious to the molten material and including an inlet and an outlet;

an inlet port imperviously sealed to the envelope at the inlet and extending outward from the inlet; and an outlet port imperviously sealed to the envelope at the outlet and extending outward from the outlet;

wherein the receptacle retains its structural integrity up to a temperature of at least 150° C.

2. The receptacle of claim 1, wherein the receptacles retains its structural integrity up to a temperature of at least 200° C.

3. The receptacle of claim 1, wherein the inlet and outlet ports are heat-scaled to the envelope at its inlet and outlet, respectively.

4. The receptacle of claim 1, further comprising a closure for the inlet port and a shutoff valve for the outlet port.

5. The receptacle of claim 1, wherein the receptacle comprises at least two of said envelopes of similar shape and size, one inside the other, and wherein the inlets of the envelopes are aligned with each other and the outlets of the envelopes are aligned with each other.

6. The receptacle of claim 5, wherein each of said envelopes is composed of facets comprising sides, a base and a top, the inlets being formed in the top facets and the outlet being formed in a side facet.

7. The receptacle of claim 6, wherein facets of each envelope are sealed together along adjoining edges, and the envelopes are sealed to one another along said adjoining edges.

8. The receptacles of claim 6, wherein the envelopes are sealed to one another at the inlets and outlets thereof.

9. The receptacle of claim 1, wherein the envelope is composed of facets comprising sides, a base and a top, the inlet being formed in the top facet and the outlet being formed in a side outlet.

10. The receptacle of claim 1, further comprising a heater in thermal contact with the envelope.

11. The receptacle of claim 10, wherein the heater is in thermal contact with an exterior of the envelope.

12. The receptacle of claim 1, wherein the envelope is constructed of a flexible sheet of a material selected from polyepsiloncaprolactam, poly(epsiloncaprolactam-hexamethylene adipamide), and a copolymer thereof.

13. The receptacle of claim 12, wherein the envelope is constructed of a flexible sheet of a copolymer of polyepsiloncaprolactam and poly(epsiloncaprolactam-hexamethylene adipamide.

14. A receptacle for containing a molten material, comprising:

a flexible envelope impervious to the molten material and including an inlet and an outlet;

an inlet port imperviously sealed to the envelope at the inlet and extending outward from the inlet; and an outlet port imperviously sealed to the envelope at the outlet and extending outward from the outlet;

wherein the inlet and outlet ports are constructed of a rigid block of material selected from the group consisting, of polyepsiloncaprolactam, poly(epsiloncaprolactam-hexamethylene adipamide), and a copolymer thereof.

15. The receptacle of claim 14, wherein the inlet and outlet ports are constructed of a rigid block of a copolymer of polyepsiloncaprolactam and poly(epsiloncaprolactam-hexamethylene adipamide.

16. The receptacle of claim 1, further comprising a rigid holder, the envelope being disposed within the rigid holder.

17. The receptacle of claim 16, wherein the holder comprises sides, a base and a cover.

18. The receptacle of claim 16, further comprising heating elements disposed between the rigid holder and the envelope, the heating elements being in thermal contact with an exterior of the envelope.

19. The receptacle of claim 18, wherein the cover of the holder includes an opening through which the inlet port extends.

20. The receptacle of claim 19, wherein a side of the holder includes an opening through which the outlet port extends.

21. A receptacle for containing, a molten material, comprising:

a flexible envelope impervious to the molten material and including an inlet and an outlet;

an inlet port imperviously sealed to the envelope at the inlet and extending outward from the inlet; and an outlet port imperviously sealed to the envelope at the outlet and extending outward from the outlet;

wherein the inlet port is constructed of a rigid block including:

a lower flange, an upper surface of the lower flange being heat sealed to an interior surface of envelope at its inlet; and a central opening therethrough for introduction of the material into the envelope from an exterior of the receptacle and an upper flange extending above the holder cover, and a retaining clip is inserted between the holder cover and the upper flange.

22. The receptacle of claim 21, wherein the outlet port is constructed of a rigid block including:

a lower flange, an upper surface of the lower flange being heat sealed to in interior surface of the envelope at its outlet; and a central opening therethrough for dispensing the molten material from the envelope to an exterior of the receptacle.

23. The receptacle of claim 22, wherein the envelope is composed of at least two layers of the flexible sheet with the inlet and outlet formed in the at least two layers.

24. A method for containing, transporting and dispensing a material, said method comprising:

providing a receptacle that comprises a flexible envelope impervious to the material when molten and including an inlet and an outlet, a rigid holder into which the flexible inlet is disposed, and a heating element disposed between the rigid holder and the envelope, and in thermal contact with an exterior of the envelope;

introducing the molten material into the envelope through an inlet port extending from the envelope inlet and an exterior of the container;

closing the inlet port, and transporting the container to a desired location;

activating the heating element to heat the material to a desired temperate in its molten state; and dispensing the material in its molten state from an outlet port extending from the envelope outlet and the exterior of the container; wherein the receptacle retains its structural integrity up to a temperature of at least 150° C.

25. The method of claim 24, wherein the receptacles retains its structural integrity up to a temperature of at least 200° C.

26. The method of claim 24, wherein the inlet and outlet ports are heat-sealed to the envelope at its inlet and outlet, respectively.

27. The method of claim 24, further comprising turning a shutoff valve on the outlet port after dispensing a desired amount of molten material, followed by repeating the steps of activating the heating element and dispensing the molten material.

28. The method of claim 24, wherein the receptacle comprises at least two of said envelopes of similar shape and size, one inside the other, and wherein the inlets of the envelopes are aligned with each other and the outlets of the envelopes are aligned with each other.

29. The method of claim 28, wherein each of said envelopes is composed of facets comprising sides, a base and a top, the inlets being formed in the top facets and the outlet being formed in a side facet.

30. The method of claim 29, wherein facets of each envelope are sealed together along adjoining edges, and the envelopes are sealed to one another along said adjoining edges.

31. The method of claim 24, wherein the envelope is constructed of a flexible sheet of a material selected from the group consisting of a polyaromatic amide, a polyimide, a copolymer of ethylene and tetrafluoroethylene, and a nylon polymer.

32. The method of claim 30, wherein the envelope is constructed of a flexible sheet of ethylene and tetrafluoroethylene.

33. The method of claim 30, wherein the envelope is constructed of a flexible sheet of a material selected from polyepsiloncaprolactam, poly(epsiloncaprolactam-hexamethylene adipamide), and a copolymer thereof.

34. The method of claim 24, wherein the inlet and outlet ports are constructed of a rigid block of material selected from the group consisting of polyepsiloncaprolactam, poly (epsiloncaprolactam-hexamethylene adipamide), and a copolymer thereof.

35. The method of claim 24, wherein the rigid holder comprises sides, a base and a cover.

36. The method of claim 24, wherein the cover of the holder includes an opening through which the inlet port extends, and a side of the holder includes an opening through which the outlet port extends.

37. The method of claim 24, wherein the inlet port is constructed of a rigid block including a lower flange, an upper surface of the lower flange being heat sealed to an interior surface of envelope at its inlet, and a central opening therethrough for introduction of the material into the envelope.

38. The method of claim 37, wherein the inlet port block further comprises an upper flange extending above the holder cover, and a retaining clip is inserted between the holder cover and the upper flange.

39. The method of claim 37, wherein the outlet port is constructed of a rigid block including a lower flange, an upper surface of the lower flange being heat sealed to in interior surface of the envelope at its outlet, and a central opening therethrough for dispensing the molten material from the envelope to an exterior of the receptacle.

40. The method of claim 38, wherein the envelope is composed of at least two layers of the flexible sheet with the inlet and outlet formed in the at least two layers.

* * * * *